US006973925B2

(12) United States Patent
Sauter et al.

(10) Patent No.: US 6,973,925 B2
(45) Date of Patent: Dec. 13, 2005

(54) VENTILATION DEVICE FOR CRANKCASE

(75) Inventors: Hartmut Sauter, Leonberg (DE); Pius Trautmann, Stuttgart (DE)

(73) Assignees: MAHLE Filtersysteme GmbH, Stuttgart (DE); Filterwerk Mann + Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/362,637

(22) PCT Filed: Aug. 22, 2001

(86) PCT No.: PCT/DE01/03286

§ 371 (c)(1),
(2), (4) Date: Feb. 25, 2003

(87) PCT Pub. No.: WO02/20954

PCT Pub. Date: Mar. 14, 2002

(65) Prior Publication Data

US 2003/0178014 A1 Sep. 25, 2003

(30) Foreign Application Priority Data

Sep. 9, 2000 (DE) ..... 100 44 615

(51) Int. Cl.[7] ..... F01M 3/04
(52) U.S. Cl. ..... 123/572
(58) Field of Search ..... 123/572, 573, 123/574; 55/337

(56) References Cited

U.S. PATENT DOCUMENTS

| | | | | |
|---|---|---|---|---|
| 2,104,683 A | | 1/1938 | Van Rosen et al. | |
| 3,234,716 A | | 2/1966 | Sevin et al. | |
| 5,239,972 A | * | 8/1993 | Takeyama et al. | 123/573 |
| 5,542,402 A | * | 8/1996 | Lee et al. | 123/573 |
| 5,746,789 A | | 5/1998 | Wright et al. | |
| 5,954,035 A | | 9/1999 | Hofer et al. | |
| 6,152,120 A | * | 11/2000 | Julazadeh | 123/572 |
| 6,536,211 B1 | * | 3/2003 | Borgstrom et al. | 60/311 |
| 6,591,820 B2 | * | 7/2003 | Kitano et al. | 123/572 |

FOREIGN PATENT DOCUMENTS

| | | |
|---|---|---|
| DE | 749 024 | 9/1952 |
| DE | 35 19 543 | 12/1986 |
| DE | 38 13 646 | 11/1989 |
| DE | 198 03 646 | 8/1999 |
| WO | WO 98 49432 | 11/1998 |
| WO | WO 01 36103 | 5/2001 |

* cited by examiner

*Primary Examiner*—Marguerite McMahon
(74) *Attorney, Agent, or Firm*—Collard & Roe, P.C.

(57) ABSTRACT

The invention relates in particular to a ventilation device for a crankcase of an internal combustion engine. Said device comprises a centrifugal oil separator, which has an inlet for an oil-air mixture, an air vent for the purified air and an oil outlet for the oil. To improve the operating efficiency of a ventilation device of this type, the centrifugal oil separator is configured as a disk separator.

16 Claims, 1 Drawing Sheet

VENTILATION DEVICE FOR CRANKCASE

CROSS REFERENCE TO RELATED APPLICATIONS

Figure 1:
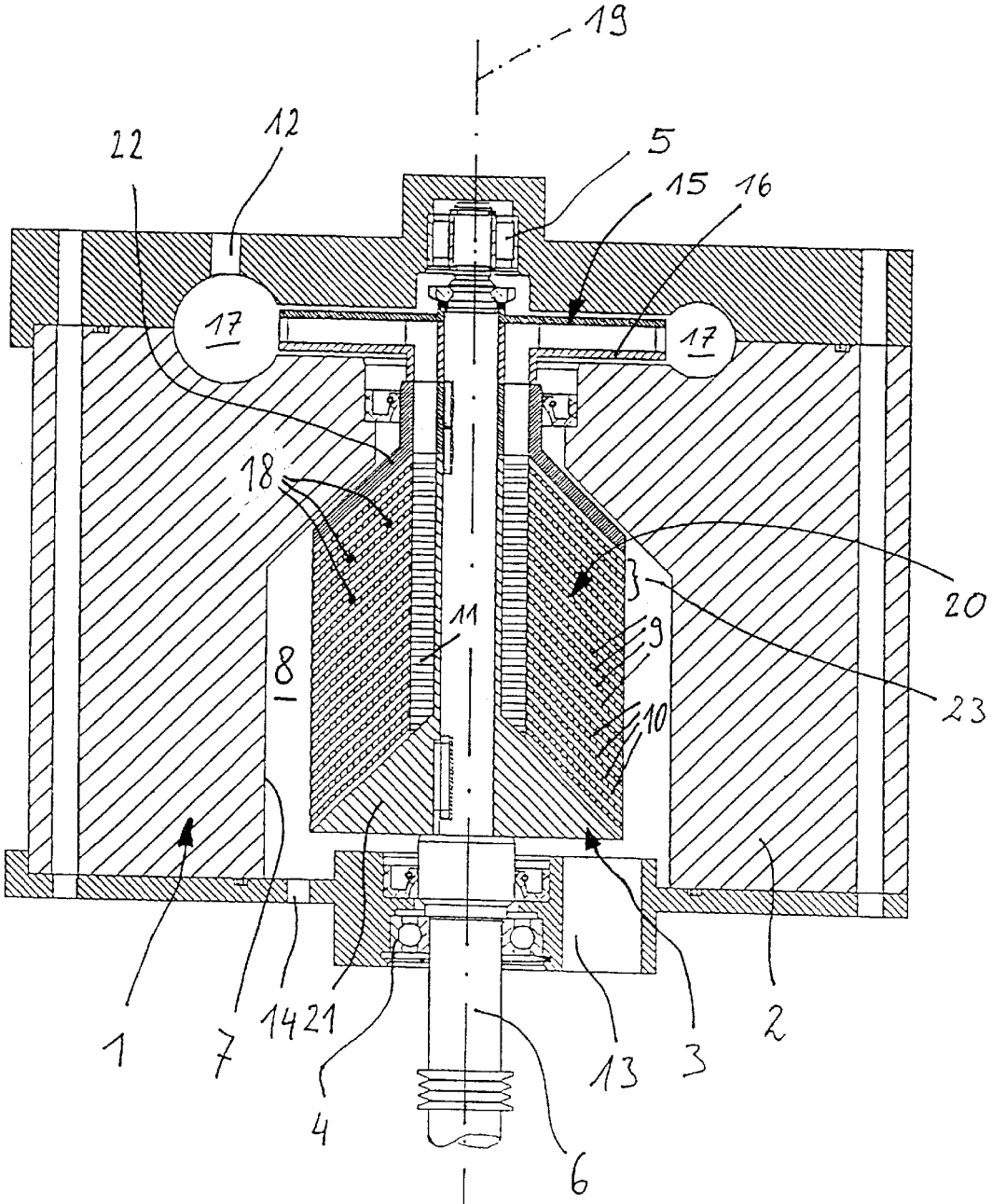

Applicant claims priority under 35 U.S.C. §119 of German Application No. 100 44 615.9 filed Sep. 9, 2000. Applicant also claims priority under 35 U.S.C. §365 of PCT/DE01/03286 filed Aug. 22, 2001. The international application under PCT article 21(2) was not published in English.

The invention relates to a venting device for a crankcase of an internal combustion engine with the characteristics of the preamble of claim 18. The invention also relates to a method according to claim 30 as well as an application according to claim 32.

Such a venting device is known, for example, from DE 198 03 872 A1 and it has a centrifugal oil separator which includes a mixture inlet for an oil-air mixture and an air outlet for clean air as well as an oil outlet for oil.

From DE 198 03 872 Al, a venting device is known which has a centrifugal oil separator which includes a mixture inlet for an oil-air mixture and an air outlet for clean air as well as an oil outlet for oil. This centrifugal oil separator has a rotationally driven housing including an exhaust funnel which is placed coaxially to the rotation axis of the housing and which forms the air outlet coaxially to the rotation axis. Radially between this exhaust funnel and an outer housing wall, the mixture inlet is essentially formed like an annulus. Baffle plates extend into this mixture inlet so that they force a multiple diversion of the oil-air mixture flow. Due to these diversion, the oil can separate out onto the baffle plates. Because of the centrifugal forces, the oil is driven towards the outer walls of the rotating housing. In these outer walls, several oil outlet holes are provided at suitable points through which the separated oil can exist the housing. Now free of oil, the clean air from inside the housing exits via the air outlet.

Usually, the clean air leaving the centrifugal oil separator is recirculated to the intake manifold of an internal combustion engine. Thus, there is a requirement that this clean air contains a minimum amount of residual oil. On the one hand, the oil consumption of the internal combustion engine can thus be lowered while, on the other hand, the emission behaviour of the internal combustion engine can be improved. For modern fuel injection devices, which incorporate highly sensitive sensors and valves, a particularly high degree of purity is desirable in order to avoid damage to sensitive components as well as adversely influencing measured values.

From the WO 01/36103 A1, a venting device of the above-mentioned type is known which uses a centrifugal oil separator designed as a plate separator. The plate separator has a stator in the shape of a housing accommodating a rotor. The rotor has several plates which are located along the rotor axis parallel to each other and coaxial to the rotor axis. Between two neighbouring plates each, a grap is formed which joins an annular space in the inner part of the rotor with a space surrounding the rotor inside the housing. The annular space of the rotor is connected with a first connection forming a mixture inlet while the space of the housing is joined to a second connection forming the air outlet as well as with a third connection forming an oil outlet. Consequently, the flow through the known plate separator rotor during its operation is radially from the inside to the outside.

Basically, plate separator are known for separating particles such as dust from a fluid stream for example, a gas flow in particular, cf. U.S. Pat. No. 2,104,683, U.S. Pat. No. 5,764,789 and U.S. Pat. No. 3,234,716 for example.

It has been proven that, with the aid of a plate separator, oil separation of a particularly high quality can be achieved so that the clean air leaving the plate separator contains only very small quantities of oil or oil mist or none at all.

The present invention deals with the object of providing a venting device of the above-mentioned type, which makes an oil separation of particularly high quality possible.

This object is solved in terms of the invention by a venting device with the characteristics of claim 1.

The invention is based on the general idea to design the plate separator such that the flow through the rotor during its operation is radially from the outside to the inside. It has been proven that, this way, the performance potential of the plate separator can be increased substantially.

By selecting the number of plates, the gap length and the pap width, a desired purification effect can be achieved for a given volumetric flow and a given pressure loss. It is evident that the purification effect is also dependent on the rotor speed.

In a further development, the plates can form a block of plates in which neighbouring plates are fixed to each other whereby this block of plates with its axial ends is firmly fixed to a central rotor shaft of the rotor. In this embodiment, the block of plates forms an assembled single component which is fixed to the rotor shaft as a unit. Consequently, at least the plates placed between the plates at the axial ends are not directly connected to the rotor shaft. The attachment of the block of plates, to the rotor shaft then takes place via the two plates at the axial ends. By this construction method, the manufacture of the plate separator can be simplified because all plates are firmly fixed once the block of plates is mounted onto the rotor shaft.

In a further development, at least two neighbouring plates can form a stack of plates which is manufactured as a single unit. Such a stack of plates can be manufactured in an injection moulding process, for example. By manufacturing these stacks of plates as single units, the associated plates are already firmly joined to each other which eliminate further steps in assembly.

In an especially preferred embodiment, a block of plates can be formed by at least one stack of plates. Since the plates in a stack of plates need not be fitted together, the manufacture of the block of plates is simplified. A further, important advantage of this embodiment obtains if several stacks of plates form the block of plates since it is then particularly easy to vary the number of plates in the block of plates. For example, a stack of plates always comprises five plates. In a first variant, the block of plates should consist of 15 plates while this number should be 20 in a second variant. The number of plates depends on the volumetric flow to be cleaned for example. Thus, in order to manufacture the first variant, three stacks of plates are joined together. Correspondingly, four stacks of plates are joined together for the second variant. The resultant additional expense for preparing two different variants is minimal.

In order to further simplify the manufacture of the plate separator, it is proposed to place spacers between neighbouring plates in the direction of the rotor axis. Thus, for the assembly of the block of plates, plates and spacers can be stacked on top of each other and joined together in one operation, e.g. in a welding process.

A further simplification can be obtained if the spacers are manufactured as single parts together with the respective plates.

The basic object of the invention is also solved by a method with the characteristics of claim 15. By this approach, the efficiency of the respective plate separator is adapted, by the number of plates, to the volumetric flow requiring oil removal.

Apart from that, the basic object of the invention is solved by an application according to claim 17.

Further important advantages and characteristics of the present invention result from the dependent claims, the drawings and the associated description of figures in the drawings.

It is to be understood that the characteristics mentioned above and to be explained below, can be used not only in the respective combination as mentioned but also in other combinations or on their own without deviating from the framework of the present invention.

Preferred embodiments of the invention are shown in the drawing and are explained in more detail in the description below.

FIG. 1, the only drawing, shows a longitudinal section through a plate separator of a venting device in terms of the invention.

According to FIG. 1, a venting device not fully shown includes a plate separator 1 which has a stator 2 and a rotor 3. The stator 2 can be attached to a crankcase of an internal combustion engine, for example. In contrast to that, the rotor 3 is rotatably placed in stator 2 whereby the stator 2 in the special embodiment shown here is fitted with appropriate radial bearings 4 and 5 in which a rotor shaft 6 of rotor 3 is rotatably mounted in stator 2.

The stator 2 forms a housing 7 in which the rotor 3 is placed. Inside of housing 7, there is also formed a space 8 surrounding the rotor 3.

The rotor 3 has several plates 9 which are placed along a rotor axis 19, i.e. parallel to each other and coaxial to the rotor axis 19. They are arranged such that they form a gap 10 each between two neighbouring plates 9. Each of these gaps 10 connects the space 8, placed radially outside of plates 9, with an annular space 11, placed radially inside of plates 9, which is formed in the inner part of rotor 3 and extends coaxially along the rotor shaft 6. This annular space 11 is joined to a first connection 12 while space 8 is joined to a second connection 13 and a third connection 14.

In the special embodiment shown here, the annular space 11 opens directly into the low pressure side of a compressor 15 which in this case has been designed as a centrifugal compressor. An impeller 16 of compressor 15 is directly and firmly fixed to the rotor shaft 6 of plate separator 1. From the low pressure side of the impeller 16, placed radially on the inside, the air provided there from the annular space 11 is forced, within the impeller 16, radially to the outside where it reaches a high pressure space 17 of compressor 15. Now, the high pressure space 17 is joined with the first connection 12. Essentially, the compressor 15 serves the purpose of compensating, on the one hand, for the pressure loss inevitably occurring during the flow through the plate separator 1. On the other hand, the compressor 15 can also be sized such that it generates a pressure increase between the second connection 13 and the first connection 12, namely across the separator-compressor-unit.

In the embodiment shown here, the first connection 12 serves as an exhaust port for the clean air which had oil removed from it, while the second connection 13 serves as a mixture inlet for the unpurified oil-air-mixture. The third connection 14 forms an oil outlet through which the separated oil can be discharged from space 8. While in the embodiment shown here, the second connection 13 is aligned parallel to the rotor axis 19, this second connection 13 in a different embodiment can also be place at an incline to or across the rotor axis 19, in particular radially to the rotor axis 19 or tangentially to the housing 7.

Spacers 18 are placed between neighbouring plates 9; however, only a few of which, for clarity, have been shown schematically in FIG. 1. These spacers 18 are shaped like raised points or spherical protrusions, or take the form of ribs. With the spacers 18, the neighbouring plates 9 are kept at a certain distance in the direction of the rotor axis 19 whereby the gaps 10 can be defined. In a preferred embodiment, these spacers 18 are manufactured as an integral part of the plates 9. For example, each plate 9 has several such spacers 18 on an upper side facing space 8, which are supported, in the assembled state, on their underside by the neighbouring plate 9, said underside facing the annular space 11.

In the embodiment shown here, the plates 9 take the form of a truncated cone shell so that the surface line of the plates 9 are inclined relative to the rotor axis 19. In this particular example, the surface line of plates 9 includes an angle of about 45° with the rotor axis 19. It is evident that other angles up to 90° are possible.

The horizontal lines shown in the annular space 11 indicate the inner edges of plates 9, placed radially on the inside, as well as the outlets of gaps 10, placed radially on the inside.

The stacked plates 9 are axially held between two holder elements 21 and 22 with their contours being engaged with the plates 9, said holder elements having a complementary shape to the plates 9 located at the outer ends respectively. That way, there is a gap 10 each between the holder elements 21, 22 and the plates 9 supported by them. Accordingly, spacers 18 can also be placed into the gaps 10, placed radially on the outside. The holder elements 21 and 22 are firmly fixed on the rotor shaft 6. Due to the shape of the holder elements 21 and 22 as well as the shape of plates 9, all plates 9 can be firmly fixed to the rotor shaft 6 with appropriate axial clamping between the holder elements 21 and 22 without the need for further fixing measures between the plates 9 and the rotor shaft 6.

The neighbouring plates 9 are individually attached to each other whereby all plates 9 are joined into a single block of plates 20. The connection between the plates can, for example, be effected via the spacers 18 which can be welded to the respective neighbouring plate 9, for example. By the same token it is possible that the plates 9 are joined together by special connection ribs or other connection elements which are not shown here, though.

The single block of plates 20 formed thus can then be mounted easily onto the rotor shaft 6 while the fixing of this block of plates 20 also takes place via the holder elements 21, 22.

In this context, it is of particular importance that none of the plates 9 are directly fixed to the rotor shaft 6 but that the attachment of the plates 9 takes place via the holder elements 21, 22. Thus, the plates 9, placed radially on the outside, can be attached to the holder elements 21 or 22 respectively, e.g. by welding or bonding. By the same token, there is a possible embodiment where axial clamping is sufficient to firmly secure the plates 9 or the block of plates, 20 to the rotor shaft 6. Furthermore, it is also possible to have a design where each plate 9 is separately fixed to the rotor shaft 6, e.g. each plate 9 has a keyed connection to the rotor shaft 6.

According to a preferred embodiment, several plates 9 can be manufactured as a single part or piece, which can be realised with the aid of a thermoplastic injection moulding process in particular. In the following, the plates 9 manufactured together as one body are referred to as "stacks of plates". It is possible, for example, to manufacture all plates 9 as a one-piece injection moulded part so that the block of plates 20 forms a stack of plates made in one piece. However, preferred are embodiments where the block of plates 20 is made up of several stacks of plates. In FIG. 1, such a stack of plates is indicated with a brace and designated 23. This stack of plates 23 comprises three plates 9 which are integrally formed as one piece.

The use of such stacks of plates 23 simplifies the manufacture of the plate separator 1 if different version of the plate separator 1 is to be provided. Preferably, the manufacture of such a plate separator 1 should be approached as follows:

The particular type of application of the plate separator 1, or the venting device to be equipped with it, has a given volumetric flow which is to be cleaned of oil. Relative to this volumetric flow, the number of plates 9 is determined which are required for the plate separator 1 in order to be able to achieve the desired degree of purity. Then, the structure of the block of plates 20 can be determined or assembled. In order to simplify the structure of the block of plates 20, the stacks of plates 23 are pre-manufactured whereby versions with different numbers of plates can also be available for example. Depending on the respective embodiment, individual plates 9 or individual stacks of plates 23 are joined together in order to form a simple unit of a desirable length, namely the block of plates 20. Finally, the plates 9 or the block of plates 20 are fixed to the rotor shaft 6 between the holder elements 21 and 22 whereby additional fixing measures can be provided for joining the block of plates 20 to the holder elements 21, 22.

The plate separator 1 is driven by its rotor shaft 6 whereby, in principle, any type of drive can be suitable for the rotor shaft 6. For example, the rotor shaft 6 can be coupled to the crankshaft of the internal combustion engine whose crankcase is meant to be vented. It is also possible to couple the rotor shaft 6 with an oil centrifuge or with an electric motor.

What is claimed is:

1. A venting device for a crankcase of an internal combustion engine with a centrifugal oil separator (1) comprising a mixture inlet (13) for an air-oil mixture and an air outlet (12) for clean air as well as an oil outlet (14) for oil, and said centrifugal oil separator being designed as a plate separator (1) having a stator (2) in the form of a housing (7) into which a rotor (3) comprising several plates (9) is placed which are located along the rotor axis (19) parallel to each other and coaxial to the rotor axis (19) whereby a gap (10) is formed between each two neighbouring plates (9), said gap joining an annular space (11) formed inside the rotor (3) with a space (8) which surrounds the rotor (3) inside the housing (7), whereby the annular space (11) of rotor (3) is joined to a first connection (12), and the space (8) of housing (7) to a second connection (13) as well as a third connection (14) which serves as the oil outlet, characterised in that the first connection (12) serves as the air outlet and the second connection (13) serves as the air inlet.

2. The venting device according to claim 1, characterised in that the plates (9) form a block of plates (20) where neighbouring plates (9) are attached to each other whereby the block of plates (20) via its axial ends is firmly fixed to a central rotor shaft (6) of the rotor (3).

3. The venting device according to claim 1, characterised in that at least two neighboring plates (9) form a stack of plates (23) manufactured as a single part.

4. The venting device according to claim 1, characterised in that the block of plates (20) is formed by at least one stack of plates (23).

5. The venting device according to claim 1, characterised in that each plate (9) essentially has the form of a truncated cone shell.

6. The venting device according to claim 2, characterised in that the surface line of plates (9) includes an angle of about 45° with the rotor axis (19).

7. The venting device according to claim 1, characterised in that in the direction of the rotor axis (19), spacers (18) are placed between neighbouring plates (9), which produce the respective gap (10).

8. The venting device according to claim 7, characterised in that the spacers (18) in combination with the plates (9) are manufactured as single parts.

9. The venting device according to claim 1, characterised in that the venting device includes a compress (15) which is placed either downstream or upstream of the plate separator (1) whereby the compressor (15) is essentially sized such that it at least compensates for a pressure loss which occurs during the flow through the plate separator (1).

10. The venting device according to claim 9, characterised in that the compressor (15) is formed as a centrifugal compressor which is located on the clean air side downstream of the plate separator (1).

11. The venting device according to claim 9, characterised in that an impeller (16) of the compressor (15) is fixed to the rotor (3) of the plate separator (1).

12. The venting device according to claim 11, characterised in that an outlet opening of the annular space (11) directly discharges into the low pressure side of the impeller (16).

13. A method for the manufacture of a plate separator (1) according to claim 1 whereby, depending on volumetric flow to be cleaned of oil, the number of plates (9) is to be determined, whereby a block of plates (20) is formed with this number of plates, whereby this block of plates (20) is then fixed to the rotor shaft (6).

14. The method according to claim 13, characterised in that the block of plates (20) is composed of several prefabricated stacks of plates (23) which are combined such that the block of plates (20) has the desired number of plates whereby the stacks of plates (23) can comprise differing plate numbers.

15. The use of a plate separator of a plate separator (1) having a stator (2) in the form-of a housing (7) into which a rotor (3) comprising several plates (9) is placed which are located along the rotor axis (19) parallel to each other and coaxial to the rotor axis (19) whereby a gap (10) is formed between each two neighbouring plates (9), said gap joining an annular space (11) formed inside the rotor (3) with a space (8) which surrounds the rotor (3) inside the housing (7), whereby the annular space (11) of rotor (3) is joined to a first connection (12), and the space (8) of housing (7) to a second connection (13) as well as a third connection (14) which serves as the oil outlet, characterised in that the first connection (12) serves as the air outlet and the second connection (13) serves as the air inlet, said plate separator being used as a centrifugal oil separator in a venting device for a crankcase of an internal combustion engine so that the first connection (12) serves as the air outlet while the second connection (13) serves as a mixture inlet.

16. The use of a plate separator according to claim 15, characterised in that the plates form a block of plates where neighboring plates are attached to each other whereby the block of plates via its axial ends is firmly fixed to a central rotor shaft of the rotor.

* * * * *

UNITED STATES PATENT AND TRADEMARK OFFICE

CERTIFICATE OF CORRECTION

PATENT NO. : 6,973,925 B2
APPLICATION NO. : 10/362637
DATED : December 13, 2005
INVENTOR(S) : H. Sauter et al.

It is certified that error appears in the above-identified patent and that said Letters Patent is hereby corrected as shown below:

In particular, in Column 6, line 15 (Line 1 of Claim 6), please change "claim 2" to correctly read as follows:

--claim 5--.

In Column 6, line 30, (Line 3 of Claim 9), please change "compress" to correctly read:

--compressor--.

Signed and Sealed this

Seventh Day of August, 2007

JON W. DUDAS
*Director of the United States Patent and Trademark Office*